US006148713A

United States Patent [19]

Gieseke

[11] Patent Number: 6,148,713

[45] Date of Patent: Nov. 21, 2000

[54] ELASTOMERIC SURFACE ACTUATION SYSTEM

[75] Inventor: Thomas J. Gieseke, Newport, R.I.

[73] Assignee: The United States of America as represented by the Secretary of the Navy, Washington, D.C.

[21] Appl. No.: 09/090,327

[22] Filed: May 22, 1998

[51] Int. Cl.[7] ..... F01B 21/02

[52] U.S. Cl. ..... 92/64; 92/92; 92/76; 92/137

[58] Field of Search ..... 92/64, 90, 92, 92/76, 137

[56] References Cited

U.S. PATENT DOCUMENTS 3,481,254 12/1969 Wetherbee ..... 92/92

5,079,999 1/1992 Negishi et al. ..... 92/48

*Primary Examiner*—Edward K. Look

*Assistant Examiner*—Thomas E. Lazo

*Attorney, Agent, or Firm*—Michael J. McGowan; James M. Kasischke; Prithvi C. Lall

[57] ABSTRACT

A system for deforming or actuating an elastomeric structure is described. The system includes a plurality of tubes joined to the elastomeric structure. The tubes extend in the direction of a desired strain to be applied to the elastomeric structure and are constrained from circumferential expansion. When a pressurized fluid is applied to the tubes, the tubes deform causing a like deformation of the elastomeric structure.

13 Claims, 4 Drawing Sheets

ELASTOMERIC SURFACE ACTUATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (a) Field of the Invention

This invention relates to a system for actuating an elastomeric structure such as an elastomeric shutter.

(b) Description of the Prior Art

Closable openings are used on vessels for a variety of purposes. For example, as shown in U.S. Pat. No. 3,151,663 to Bohner et al., an inflatable closure apparatus is used to close an opening to a compartment in which a retractable wheel is stored. The closure apparatus has a plurality of inflatable tubes which are moved from a retracted position where the compartment is open to an extended position where the compartment is closed. A mechanical closure system having a plurality of links actuated by piston cylinder devices is used to move the inflatable tubes between the retracted and extended positions.

In the hull of a submarine vessel, closable openings are needed for the ejection of weapons, unmanned undersea vehicles, countermeasures, waste, and for the ingestion of water and unmanned undersea vehicles into the submarine. An elastomeric shutter system has been developed to act as closures for these openings. U.S. Pat. No. 5,419,232 to Curtis illustrates one such system in which an elastomeric shutter is drawn open using a cable system and a suitable attachment to the shutter. U.S. Pat. No. 5,450,807 to Moody illustrates yet another submarine closure system.

Under some circumstances, mechanical articulators may be an adequate approach to actuating a flexible surface, however other situations exist when the desired surface deformations are too complex to be produced by a series of pushing and pulling articulators or when the required articulation hardware cannot be fit into the available space surrounding the elastomeric part. Thus, an alternative actuation system is needed.

Inflatable tubes have been used in a variety of different environments for a variety of different purposes. For example, U.S. Pat. No. 2,404,801 to Hollerith illustrates an expander tube for a hydraulic brake which is arranged to expand outwardly upon being subjected to internal pressure by means of hydraulic fluid. U.S. Pat. No. 3,924,519 to England illustrates an actuator formed of an elastic tubing having a circumferential reinforcement therein and having a portion of the transverse periphery with longitudinal cords of tension resistant material along only one side of the tubing. In its relaxed state the device is substantially linear, but upon introduction of a pressurized fluid therein the tube curls about the side having the longitudinal reinforcing cords and upon release of the pressurized fluid the device returns to a substantially linear state. This actuator has utility in moving disabled or human handicapped limbs.

U.S. Pat. No. 3,464,322 to Pequignot illustrates a deformable diaphragm intended to produce impulsing or pumping effects in a fluid. The diaphragm is formed by a tube of elliptical section wound in a spiral with adjacent turns welded together and the outer edge being gripped in a support. The tube is connected to a source of fluid under pressure, the admission of which causes deformation of the tube and consequent inflation of the diaphragm.

U.S. Pat. No. 5,251,538 to Smith relates to an apparatus for handling a workpiece comprising a vessel that is longitudinally extensible and pressurizable, and a nonextensible and laterally flexible member on the vessel. The member constrains one side of the vessel to be nonextensible causing the vessel to bend in the direction of the nonextensible member when pressurized.

None of these actuation devices is well suited for operating an elastomeric structure, such as an elastomeric shutter system, for closing openings in the surface of a ship hull.

SUMMARY OF THE INVENTION

Accordingly, it is an object of the present invention to provide an improved actuating system for an elastomeric structure.

It is a further object of the present invention to provide a system as above which does not utilize mechanical articulation hardware.

It is yet a further object of the present invention to provide an actuation system as above which is an integral part of a deformable elastomeric structure.

The foregoing objects are attained by the actuation system of the present invention.

In accordance with the present invention, a system for actuating an elastomeric structure broadly comprises means for deforming the elastomeric structure. The deforming means comprises means for applying a strain to the elastomeric structure in a desired direction and means for constraining the elastomeric structure so that resistance to the strain causes the elastomeric structure to buckle and deform. The strain applying means comprises a plurality of inflatable tubes which are arranged in the desired strain direction and whose ends are constrained. Each tube is connected to the elastomeric structure to be deformed and to means for preventing excessive circumferential expansion.

As used herein, the term elastomeric structure includes, but is not limited to, an elastomeric surface, an elastomeric sheet, and an elastomeric shutter system.

BRIEF DESCRIPTION OF THE DRAWINGS

Other details of the actuation system of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
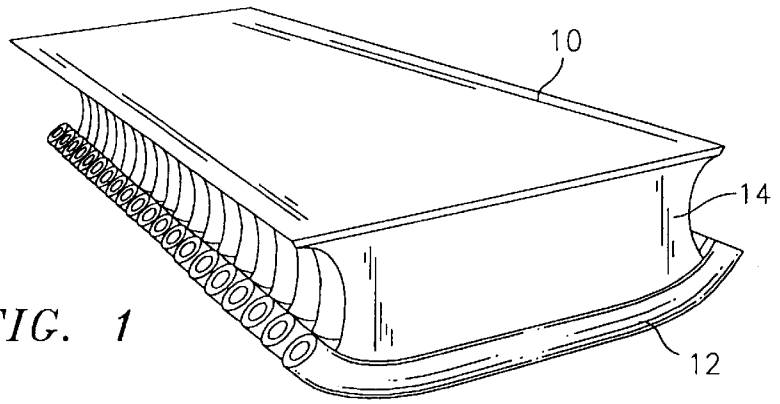
FIG. 1 is a perspective view of an actuation system for an elastomeric shutter in an undeformed state.

Referring now to the drawings, FIG. 1 illustrates an actuation system for an elastomeric structure 10 in an undeformed state. The elastomeric structure 10 may be an elastomeric surface, an elastomeric sheet or an elastomeric shutter for closing an opening in the hull of a seagoing vessel such as a boat or a submarine. The actuation system includes a plurality of tubes 12 attached to the elastomeric structure 10 by a plurality of webs or membranes 14. Details have been omitted from FIGS. 1 and 3 for purposes of clarity.

Figure 2:
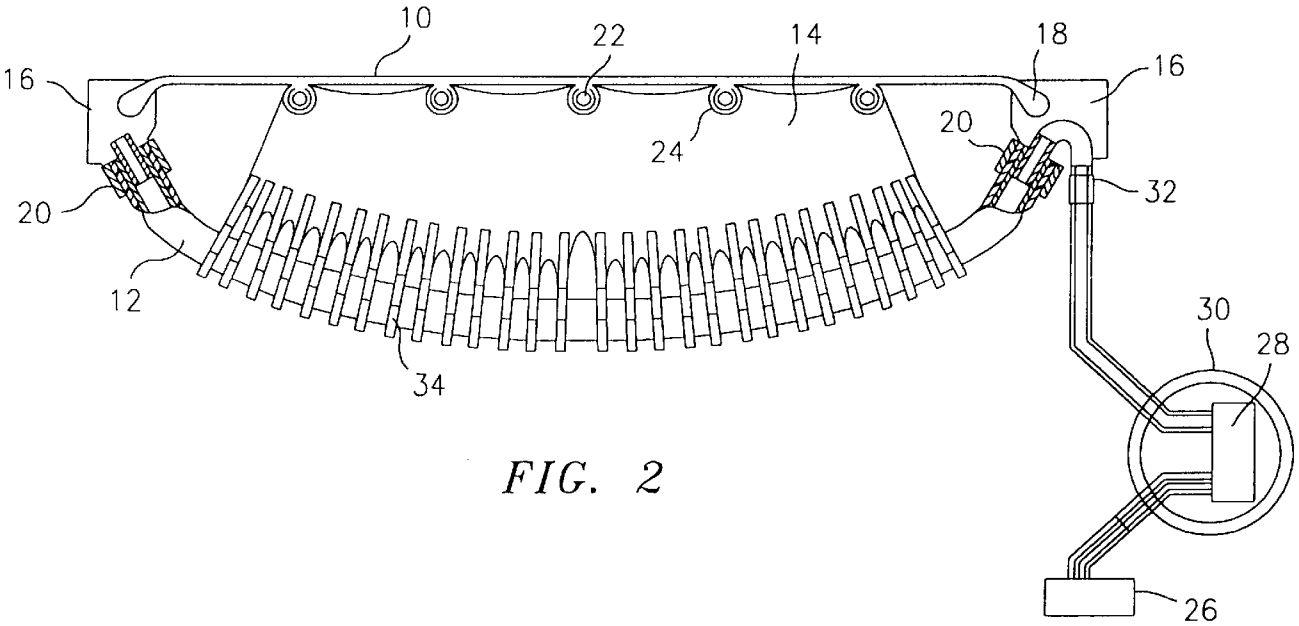
FIG. 2 is an end view of a portion of the actuation system of FIG. 1.

FIG. 2 illustrates in more detail the components of the actuation system of the present invention. As shown in FIG. 2, at the site of each membrane 14, the elastomeric structure 10 is constrained along its edges by fixed components 16. The fixed components 16 may be formed from metal or plastic material. Each one has a slot or groove 18 for receiving an edge portion of the elastomeric structure 10. The fixed components 16 also have a connector 20 which fixes the ends of the tube 12.

The underside of the elastomeric structure 10 has a plurality of attachment rods 22 connected thereto. The attachment rods 22 can be attached to the elastomeric structure 10 in any desired manner. The membrane 14 has a plurality of rigid attachment couplings 24 for receiving the rods 22 and holding them in place by a snap fit. In this way, the elastomeric structure 10 is joined to the membrane 14.

Figure 8:
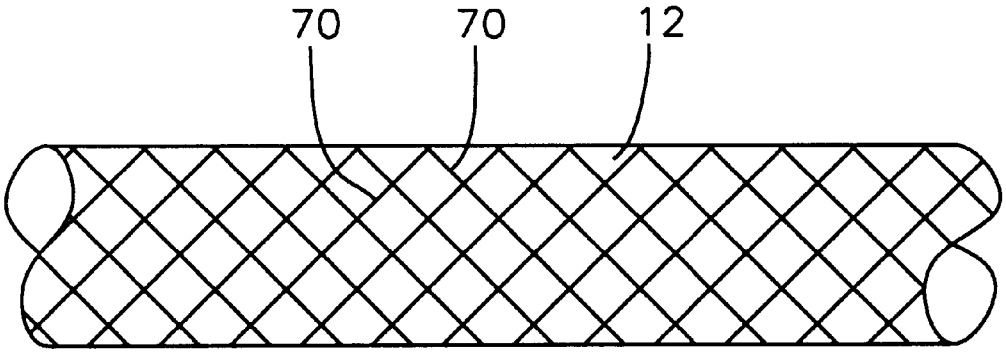
FIG. 8 is a perspective view of a portion of a reinforced tube used in the actuation system of FIG. 1 showing banding in a single layer.
Figure 9:
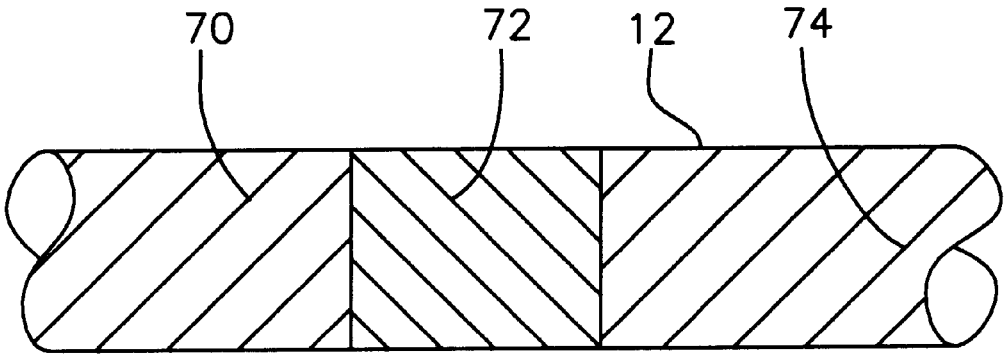
FIG. 9 is a perspective view of a portion of the reinforced tube used in the actuation system of FIG. 1 showing banding present in multiple layers.

The tube 12 is joined to a source of pressurized fluid 26 via a pressurized fluid control valve 28 in a fluid control valve housing 30 and a flexible pressurized fluid supply line 32. The tube 12 is a reinforced tube which is not allowed to expand circumferentially as a result of the application of pressurized fluid. Each tube 12 preferably is a composite structure comprised of an elastomeric tube surrounded on both sides by reinforcing bands 70. The banding prevents excessive expansion and contraction of the tube 12 when the actuation system is pressurized or evacuated. The banding may be present in a single layer as shown in FIG. 8 or may be present in multiple layers as shown in FIG. 9. For example, the banding may comprise multiple banding layers 70, 72, and 74 helically wrapped in alternating directions.

Figure 4:
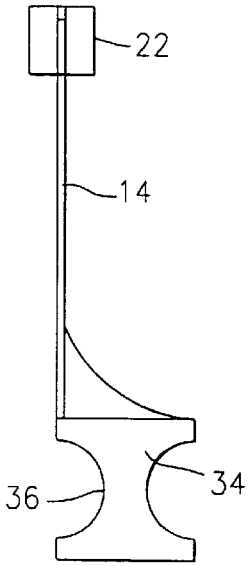
FIG. 4 is a side view of a membrane used in the actuation system of FIG. 1.
Figure 5:
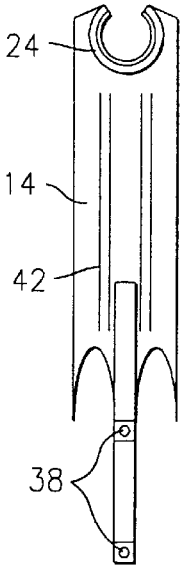
FIG. 5 is a front view of a portion of the membrane of FIG. 4.
Figure 6:
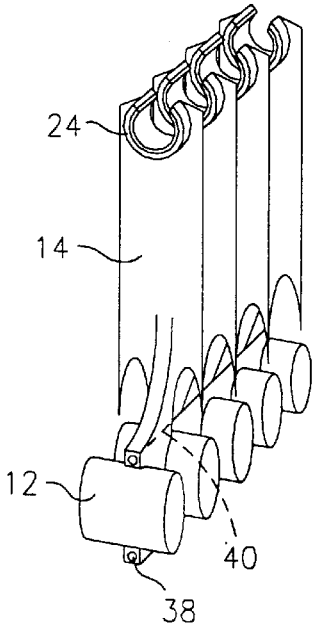
FIG. 6 is a perspective view of a plurality of membranes connected together.

Each tube 12 is arranged to extend in the direction of the desired strain to be applied to the elastomeric structure 10. Each tube is connected to the web or membrane 14 by a plurality of collars 34. Referring now to FIGS. 4 and 5, the collar 34 is attached to a lower edge of the membrane 14. Any suitable means known in the art may be used to join the collar 34 to the membrane 14. Each collar 34 includes two substantially semicircular tube attachments 36. Each tube attachment 36 surrounds a portion of the periphery of a tube 12 and thereby joins the tube 12 to the web 14. Two tube attachments 36 are provided in each collar 34 to link adjacent tubes attached to adjacent membranes together. As shown in FIGS. 5 and 6, each collar 34 contains two holes 38. A reinforcing cable 40 is passed through the holes 38 to connect adjacent collars, and thereby connect adjacent membranes 14. When two adjacent tube collars 34 are joined together, the semicircular tube attachments 36 completely surround one of the tubes 12 so as to connect the tubes 12 to web 14. Additionally, the interconnection of the adjacent tube attachments 36 helps prevent the tubing 12 from buckling in an undesirable fashion when pressurized.

Referring now to FIG. 5, each membrane 14 is relatively thin and has a plurality of reinforcing fibers 42 incorporated therein. The purpose of the fibers 42 is to resist any expansion between the elastomeric structure 10 and the tube 12 when the tube is pressurized and ultimately deformed. The fibers 42 may be formed from any material strong enough to accomplish this purpose. For example, the fibers 42 may be KEVLAR® fibers or another suitable polycarborate reinforcing material.

Figure 3:
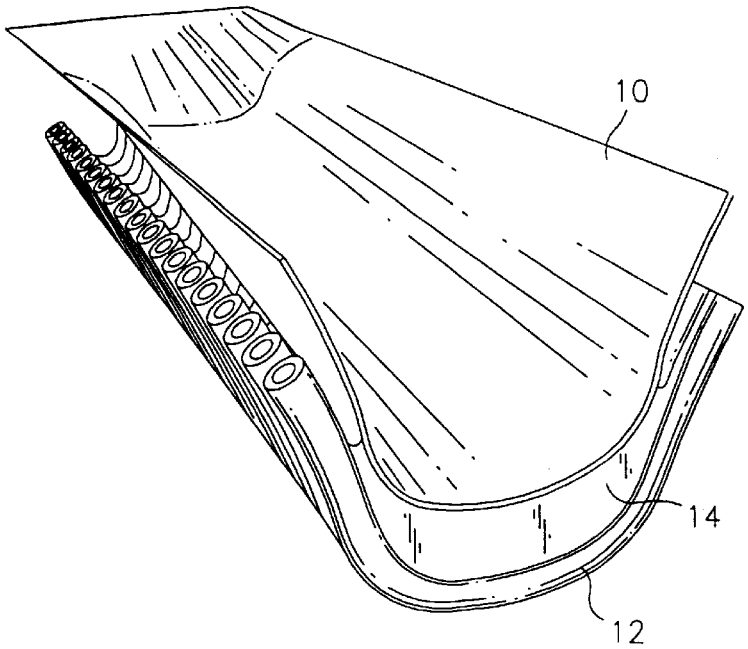
FIG. 3 is a perspective view of the actuation system with the elastomeric shutter in a deformed state.

The actuation system of the present invention deforms an elastomeric structure 10, such as an elastomeric sheet or a shutter, from one having a flat surface 10 such as that shown in FIG. 1 to one having a surface having a depression in it such as that shown in FIG. 3. The basic operation of the articulation system is as follows. The elastomeric structure 10 is attached to a series of tubes 12 as described hereinbefore. The tubes 12 lay beneath the elastomeric structure 10 in the direction of the desired strain and are attached to the elastomeric structure 10 so as to effectively act as an integrated part of the structure. The tubes 12 are fixed at both ends by the connectors 20 and are pre-bent into a curved shape. When the tubes 12 are pressurized as a result of fluid from the source 28 filling the tubes, they inflate and expand longitudinally because the reinforcing bands incorporated into tubes 12 prevent the tubes 12 from expanding circumferentially. As the tubes 12 expand longitudinally, they buckle in a particular direction, such as inwardly. Since the elastomeric structure 10 is constrained along its edges so as to resist the strain caused by the tubes 12 and since the elastomeric structure 10 is joined to the tubes 12, the structure 10 buckles and deforms.

Figure 7:
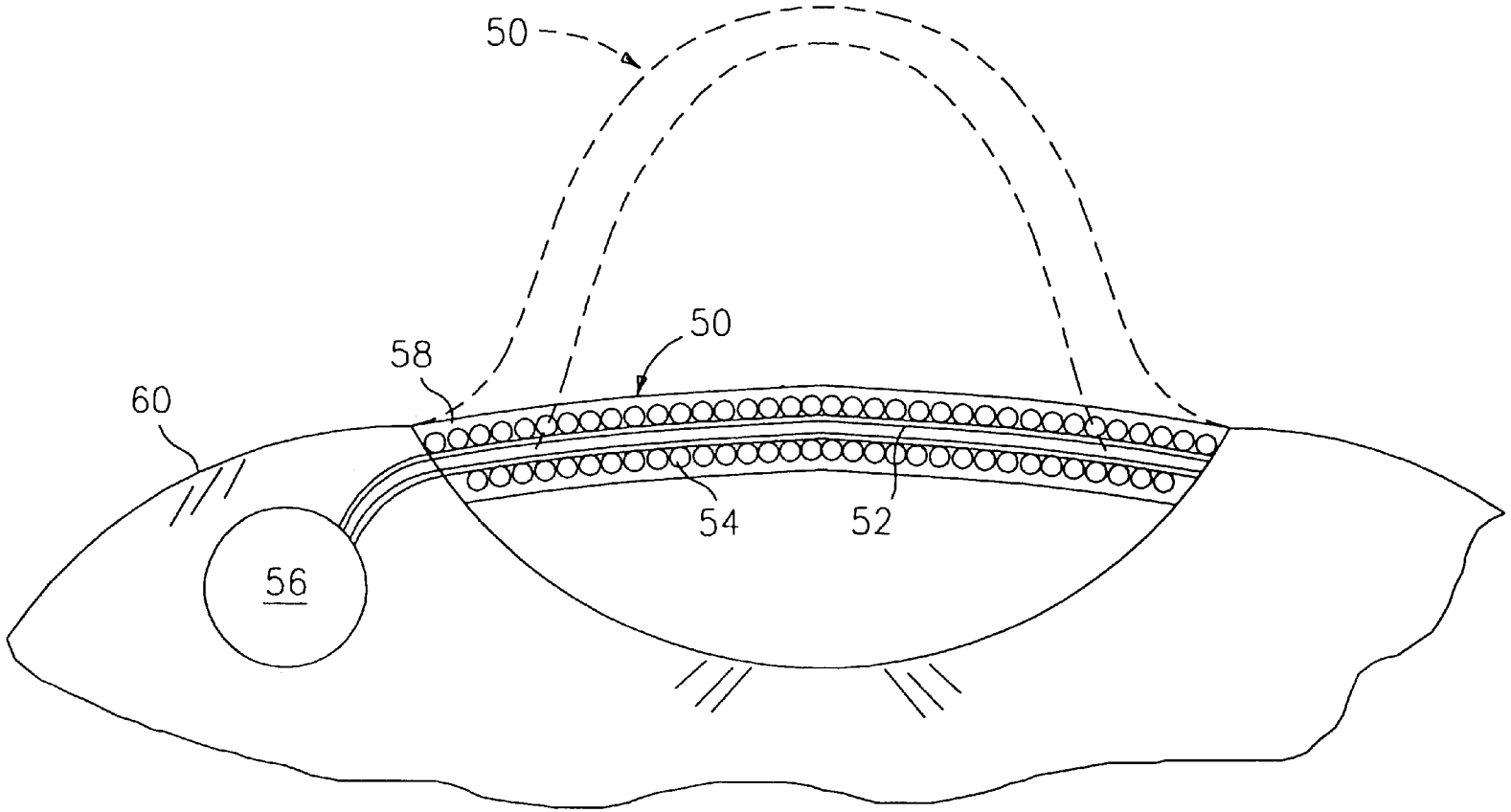
FIG. 7 is a sectional view of an actuation system embedded within an elastomeric structure.

While the embodiment of FIG. 1 shows the actuation system attached to one side of an elastomeric structure, it possible to embed the actuation system within the elastomeric structure. FIG. 7 illustrates such an arrangement.

FIG. 7 shows a cross section of an elastomeric structure 50 containing embedded elastomeric tubes 52 in an undeformed state. The elastomeric tubing 52 is encased within rigid preferably metallic reinforcements 54 and connected to a pressure source 56. The elastomeric structure 50 is constructed by encasing the tubing 52 within a compliant material 58 which can be easily stretched. The compliant material could be a sponge or rubberized foam material. When attached to a solid housing 60 and inflated using the pressurization source, the structure deforms into a shape similar to that shown by the dotted lines in FIG. 7. When the tubes 52 are embedded within the elastomeric structure, no interconnecting webbing is required and the strain in the tubing 52 would be realized as the strain in the surface itself.

The primary advantage of the actuation system of the present invention is that it eliminates the complex mechanical mechanisms previously required to actuate a flexible surface. By integrating inflatable elastic tubes into or with the elastomeric structure, the structure can be deformed by the distribution of pressurized fluid into those tubes. The hardware required for the actuation system of the present invention is smaller, lighter and more easily configured than conventional cable or actuator driven systems.

Other advantages of this actuation system over conventional actuation systems are that because the system can be an integral part of the deformable structure, the actuator attachments can be eliminated. In addition, no space is required for placement of an actuator or powering system at the location where the surface deformation is required. The pressurization source can be located in a remote location and the pressurized fluid pump transmitted through long hoses to the actuated structure. This makes it possible to place deformable structures on thin appendages where it would not be possible to place mechanical actuators.

The actuation system of the present invention may be used in a number of different systems. For example, it may be used to deform a wing or fin to induce changes in camber for lift control. It could be used to deform a wing or fin to modify the wing cross section for transition, lift and drag control. It may be used to deflect a wing or fin tip for vehicle control. It may be used to deflect a wing or fin trailing edge for production of moments on the wing or fin. It may be used to deform a streamlined body shape to prevent separation and transition and/or to induce body forces used to control a vehicle. It may also be used to provide unsteady actuation of a fin as a flapping propulsor. It may also be used to produce surface waves on elastomeric surfaces for propulsion. It may be used to manipulate a duct, venturi, nozzle, or diffuser shape to control the pressure distribution in the component.

It is apparent that there has been provided in accordance with the present invention an elastomeric surface actuation system which fully satisfies the objects, means, and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A system for deforming an elastomeric structure, said system comprising:

a plurality of tubes extending in the direction of a strain to be applied to the elastomeric structure and attached to said elastomeric structure;

means for constraining said elastomeric structure so that resistance to said applied strain causes said elastomeric structure to buckle and deform; and a membrane connecting each said tube to said elastomeric structure, said membrane having means for resisting expansion between said elastomeric structure and said tube incorporated therein.

2. The system of claim 1 further comprising a source of pressurized fluid connected to each of said tubes so that when each tube is pressurized, the tube inflates and applies longitudinal strain.

3. The system of claim 1 further comprises means for preventing excessive circumferential expansion of said tube joined to each said tube, said preventing means also preventing contraction of said tube when said system is evacuated.

4. The system of claim 3 wherein said expansion preventing means comprises reinforcing bands surrounding each said tube.

5. The system of claim 4 wherein said reinforcing bands comprises multiple banding layers helically wrapped in alternating layers about said tube.

6. The system of claim 4 wherein said reinforcing bands lie in a single banding layer.

7. The system of claim 1 wherein each said tube is constrained at a first end and at a second end opposed to said first end and each said tube is pre-bent in a curved shape so that each said tube buckles in a desired direction when inflated by a pressurizing fluid, thereby deforming said elastomeric structure.

8. The system of claim 1 wherein said expansion resisting means comprises reinforcing fibers embedded within said membrane.

9. The system of claim 8 further comprising:

a means for connecting each membrane to said elastomeric structure; and a means for connecting each said tube to a respective membrane.

10. The system of claim 9 wherein said elastomeric structure has a plurality of rods connected to one of its surfaces and said means for connecting each membrane to said elastomeric structure comprises means for receiving said rods.

11. The system of claim 9 further comprising:

a reinforcing cable interconnecting said tube connecting means;

said tube connecting means comprising:

a plurality of collars attached to said membrane, each said collar having means for receiving and restraining at least one said tube; and a means for receiving said reinforcing cable, said reinforcing cable connecting said collar to at least one adjacent collar.

12. The system of claim 1 wherein said tubes are embedded within said elastomeric structure.

13. A system for deforming an elastomeric structure, said system comprising:

a plurality of tubes extending in the direction of a strain to be applied to the elastomeric structure and attached to said elastomeric structure;

means for constraining said elastomeric structure so that resistance to said applied strain causes said elastomeric structure to buckle and deform;

a plurality of membranes extending in said direction of said desired strain;

at least one attachment collar having an aperture, said attachment collar connecting each said membrane to one of said tubes;

pressurizing means joined to said tubes; and a reinforcing cable passing through said aperture in adjacent ones of said collars and thereby connecting adjacent ones of said membranes so as to prevent said tubes from buckling in an undesirable fashion when pressurized by said pressurizing means.

* * * * *